US006219013B1

(12) United States Patent
Amano

(10) Patent No.: US 6,219,013 B1
(45) Date of Patent: Apr. 17, 2001

(54) METHOD OF DRIVING AC DISCHARGE DISPLAY

(75) Inventor: Yoshifumi Amano, Kamakura (JP)

(73) Assignee: Technology Trade and Transfer Corp., Kamakurashi (JP)

( * ) Notice: Subject to any disclaimer, the term of this patent is extended or adjusted under 35 U.S.C. 154(b) by 0 days.

(21) Appl. No.: 09/319,154

(22) PCT Filed: Oct. 6, 1998

(86) PCT No.: PCT/JP98/04516

§ 371 Date: Aug. 13, 1999

§ 102(e) Date: Aug. 13, 1999

(87) PCT Pub. No.: WO99/18561

PCT Pub. Date: Apr. 15, 1999

(30) Foreign Application Priority Data

Oct. 6, 1997 (JP) ..... 9-309175
May 18, 1998 (JP) ..... 10-173785

(51) Int. Cl.[7] ..... G09G 3/28
(52) U.S. Cl. ..... 345/60; 315/169.4; 345/68
(58) Field of Search ..... 345/60–63, 65, 345/68, 71; 315/169.1–169.4

(56) References Cited

U.S. PATENT DOCUMENTS 4,684,849 * 8/1987 Otsuka et al. ..... 315/169.4
5,210,468 * 5/1993 Yoshioka ..... 315/169.4
5,444,335 * 8/1995 Matsumoto et al. ..... 315/246
5,541,618 * 7/1996 Shinoda ..... 345/60

* cited by examiner

*Primary Examiner*—Amare Mengistu
*Assistant Examiner*—Jimmy H. Nguyen
(74) *Attorney, Agent, or Firm*—Bauer & Schaffer, LLP

(57) ABSTRACT

According to the present invention, in a driving method for an AC type discharge display device having one pair of discharge electrodes which are opposite to each other to cross through a discharge gas and each of which is constituted by a plurality of line-shaped electrodes, the plurality of line-shaped electrodes of at least one discharge electrode of the one pair of discharge electrodes being covered with a dielectric layer, an AC discharge keeping pulse Vxy to be applied across one pair of discharge electrodes is constituted by a first pulse and a second pulse having a polarity reverse to the polarity of the first pulse and generated next to the first pulse, the first pulse is made a narrow-width pulse having a pulse width set within a time in which a priming effect of charged particles or metastable atoms generated by the first pulse is kept in a discharge space, the second pulse is made a wide-width pulse which is generated before the priming effect obtained by the first pulse is disappeared and within a time being close to the first pulse and also has a pulse width for giving a sufficient time until a discharging is stopped by forming wall charges on the dielectric layer, and the AC discharge keeping pulse constituted by the first and second pulses is continuously applied across the one pair of discharge electrodes to perform a sustain discharging, so that a driving method for an AC type discharge display device which can decrease influence of an ion impact on a discharge electrode or a phosphor can be obtained.

3 Claims, 5 Drawing Sheets

Tad
Tst

0
Vy

0
Vx

0
Vxy
t0
t1
t2
t3
t4
Vb2

0
Vsy
Vb1

Tad
Tst

V1
Vx
0
t0
t1
t2
t3

V2
0
Vy
-V3
V1+V3

V3
Vxy
0
-V2
V1

0
Vsx
-Vw
-(V1+V2+Vw)

METHOD OF DRIVING AC DISCHARGE DISPLAY

TECHNICAL FIELD

The present invention relates to a driving method for an AC type discharge display device.

BACKGROUND ART

Discharge display devices {plasma display panels (PDPs)} using a scheme for performing a light emission by using gas discharging are roughly classified into an AC type discharge display device (AC type PDP) having one pair of discharge electrodes which are opposite to each other to cross through a discharge gas, each of which is constituted by a plurality of line-shaped electrodes, and both of the pair of discharge electrodes are covered by a dielectric layer, and a DC type discharge display device (DC type PDP) in which a pair of discharge electrodes both have metals on the electrode surfaces exposed to a discharge space. As an intermediate type discharge display device therebetween, a semi-AC type or semi-DC type display discharge device (semi-AC type or semi-DC type PDP) in which one discharge electrode of one pair of discharge electrodes is covered with a dielectric layer, and a metal on the electrode surface of the other discharge electrode is exposed to a discharge space is known.

There is also provided a color discharge display device (color PDP) in which infrared rays generated from gas discharging are irradiated on phosphor layers for emitting red, green, and blue lights to perform a color display. In this color discharge display device, the phosphor layer directly receives ion impact in a gas, or materials spattered by ion impact to the discharge electrode are accumulated on the surface of the phosphor, so that the phosphor must be prevented from being degraded.

Therefore, in a color discharge display device, first, the discharge electrodes must be strong against the ion impact. With respect to this point, an AC type discharge display device is advantageous. More specifically, in the AC type discharge display device, the discharge electrodes are covered with a dielectric layer such as low-melting-point glass or the like, and the surfaces of the discharge electrodes are covered with an electrode protecting layer which also serves as a secondary electron discharging material such as a magnesium oxide (MgO) or the like for protecting the electrodes from the ion impact. For this reason, it is not likely that materials spattered by the ion impact received by the discharge electrodes are accumulated on the phosphor layers, and high reliability can be obtained.

By the way, since in the AC type discharge display device, one pair of electrodes opposite to each other through a discharge space is not classified into anode and cathode electrodes, either of discharge electrodes may receive the ion impact. For this reason, an AC type discharge display device of an opposite-two-electrode type which has the simplest structure and can be easily manufactured is not easily used as a color discharge display device. Therefore, an AC type discharge display device of a surface-discharge three-electrode type in which a discharge electrode for a display is separated from an address electrode to assure an area on which a phosphor is coated has been practically used. However, the price of this AC type discharge display device is high because of a large number of electrodes. The high price hinders achievement of high resolution.

The problems of the opposite-two-electrode type discharge display device with respect to a conventional driving method will be described below with reference to FIG. 5 showing an example of the semi-AC type discharge display device serving as an opposite-two-electrode type discharge display device. The semi-AC type discharge display device shown in FIG. 5 is constituted by an AC type Y electrode 1 serving as one discharge electrode constituted by a plurality of line-shaped electrodes and a DC type X electrode 3 serving as the other discharge electrode constituted by a plurality of line-shaped electrodes, and the AC type Y electrode 1 and the DC type X electrode 3 are opposite to each other to cross through a discharge gas, i.e., are arranged in the form of a matrix.

The Y electrode 1 is constituted by line-shaped electrodes (transparent electrodes) covered with a dielectric layer 2, each having a predetermined width, and arranged at a predetermined interval, and is formed on a front-surface glass plate (not shown). The X electrode 3 is constituted by metal wires (stripe electrodes may also be used) each having a predetermined diameter, arranged at a predetermined interval, and consisting of stainless steel, nickel or the like each having a predetermined diameter and arranged at a predetermined interval, and the electrode surfaces of the electrodes are exposed to a gas space. The X electrode 3 is opposite to the inner walls of a large number of trenches 4 formed on a rear-surface glass plate 6 by an etching method, a sand blast method or the like to be close to or be in contact with the inner walls, and phosphor layers 5 for emitting red, green, and blue lights are formed to be sequentially and cyclically covered on the inner walls of the trenches 4.

FIGS. 1A to D show timing charts for explaining sustain discharging for memory discharging which is a prior art of a driving method for a discharge display device (the above mentioned semi-AC discharge display device in FIG. 5). The timing charts will be described below. Reference symbol Tad denotes an address period, and Tst denotes a sustain period.

FIG. 1C shows a waveform of a voltage Vxy between the X electrode 3 and the Y electrode 1. This waveform is an AC pulse waveform which is symmetrical with respect to positive and negative sides. In order to apply the voltage Vxy having the waveform shown in FIG. 1C across the X electrode 3 and the Y electrode 1, as shown in FIGS. 1A and B, two pulse voltages Vy and Vx which are negative pulses having the same waveform and have a predetermined phase difference are applied to the Y electrode 1 and the X electrode 3, or the voltage having the waveform shown in FIG. 1C may be applied to any one of the Y electrode 1 and the X electrode 3, and the voltage of the other electrode may be set to be zero.

FIG. 1D shows a discharge keeping pulse applied to one pair of display electrodes, i.e., the Y electrode 1 and the X electrode 3 and only a change in electrode surface potential caused by wall charges generated by the discharge keeping pulse. A description of the process in which wall charges depending on a picture screen are formed on a selected cell by an address operation performed prior to the change in electrode surface potential will be omitted. More specifically, the explanation is made on the sustain period Tst where the wall charges have been formed on the Y electrode 1 and the X electrode 3 or both the electrodes in an address period Tad, and the memory discharging is performed by applying the discharge keeping pulse.

A state that negative wall charges are formed in the address period Tad on the Y electrode 1 serving as an AC type electrode is assumed, and the pulse voltage Vy having a waveform shown in FIG. 1A is applied to the Y electrode 1 in the sustain period Tst. Since the other electrode X3 is a DC type electrode, no wall charges are formed on the X electrode 3. However, a pulse voltage Vx shown in FIG. 1B and having a phase difference of 180° with respect to the pulse voltage shown in FIG. 1A is applied to the X electrode 3.

In this manner, since positive and negative charges generated by wall charges when respective pulse voltages are applied are alternately reversed and superposed one another, the voltage Vxy applied across the X electrode 3 and the Y electrode 1 becomes the an AC pulse voltage having a waveform shown in FIG. 1C. More specifically, as shown in FIG. 1D, since it is assumed that negative charges are accumulated on the Y electrode 1 first, the voltage superposed with the voltage Vy having the waveform shown in FIG. 1A exceeds a discharge start voltage Vb1. For this reason, a first discharging occurs. Then, the negative charges on the Y electrode 1 are eliminated, and, subsequently, positive wall charges are formed. Since the wall charges boost the electrode surface potential of the Y electrode 1, when a negative pulse is applied to the X electrode 3 as shown in the waveform of FIG. 1B, a second discharging occurs, and negative wall charges are generated on the Y electrode 1 again. In this manner, continued keeping discharging is performed. Since no charged particles have been left in a discharge space at the start of the second discharging, the conditions at the start of the second discharging are almost the same as those at the start of the first discharging. For this reason, a second discharge start voltage Vb2 is a high voltage equal to the first discharge start voltage Vb1.

According to the driving method of the prior art described with reference to the timing charts in FIG. 1, by the sustain waveform applied, both the electrodes are symmetrically positive and negative, so that either of the electrodes is on the negative side at the same probability. At this time, the electrode necessarily receives the ion impact. Therefore, a place on which a phosphor layer is coated must be set at a position except for a position on the electrodes and near the electrodes. However, in a discharge display device having a fine discharge space, the place cannot be easily assured.

In addition, by the sustain waveform of the first prior art, generation of wall charges is ended by each discharging upon pulse application, and no charged particles have existed in the discharge space, and the next pulse is applied at a timing at which the number of metastable atoms becomes small. For this reason, since discharging always occurs in a state wherein a priming effect is small, a start voltage is high, and the ion impact increases because of the high start voltage.

In consideration of the circumstances, according to the present invention, in a driving method for an AC type discharge display device having a simple structure and a two-electrode structure which can be easily manufactured, there is provided a driving method which can decrease influence of ion impact on a discharge electrode or a phosphor and at the same time can cause the discharge display device to have the same memory function as that of a conventional AC type discharge display device.

DISCLOSURE OF INVENTION

The first present invention provides a driving method for an AC type discharge display device having one pair of discharge electrodes which are opposite to each other to cross through a discharge gas and each of which is constituted by a plurality of line-shaped electrodes, the plurality of line-shaped electrodes of at least one discharge electrode of the pair of discharge electrodes being covered with a dielectric layer, wherein an AC discharge keeping pulse applied across one pair of discharge electrodes is constituted by a first pulse and a second pulse having a polarity reverse to the polarity of the first pulse and generated next to the first pulse, the first pulse is a narrow-width pulse having a pulse width set within a time in which a priming effect of charged particles or metastable atoms generated by the first pulse is kept in the discharge space, a second pulse is a wide-width pulse which is generated before the priming effect obtained by the first pulse is disappeared and within a time being close to the first pulse and has a pulse width for giving a sufficient time until discharging is stopped by forming wall charges on the dielectric layer, and the AC discharge keeping pulse constituted by the first and second pulses is continuously applied across the pair of discharge electrodes to perform a sustain discharging.

The second present invention provides a driving method for an AC type discharge display device having first and second discharge electrodes which are opposite to each other to cross through a discharge gas and each of which is constituted by a plurality of line-shaped electrodes, the plurality of line-shaped electrodes of at least one discharge electrode of the first and second discharge electrodes being covered with a dielectric layer, wherein a discharge display period in which a sustain pulse is applied across one pair of discharge electrodes is constituted by a first period serving as a beginning period, a second period serving as an intermediate period, and a third period serving as a last period, the first period is made a relatively short period in which an external voltage is superposed on a wall voltage generated by negative address wall charges formed on the dielectric layer in an address period Tad in advance to generate a high discharge space voltage, a first sustain display discharging for causing an ion impact to be made on a discharge electrode where negative wall charges are formed on the dielectric layer to generate negative glow is excited, and a plasma constituted by positive and negative charged particles and metastable atoms generated by the first sustain display discharging sufficiently remains while negative address wall charges on the dielectric layer are being eliminated to form positive wall charges, the second period is made a relatively short period in which the positive wall charges newly formed on the dielectric layer in the first period switch an external drive voltage and its polarity such that a discharge current having a direction being opposite to the direction of a discharge current flowing in the first period flows by the conductivity of the remaining plasma, the switched external drive voltage is made gradually high such that strong ion impact is prevented from being made on the discharge electrode in which a space voltage is excessively high by superposing the positive wall charges newly formed on the dielectric layer on the switched external drive voltage, and further the positive wall charges are gradually eliminated such that a discharge space plasma remains or is newly formed to cause the newly generated discharge space to keep a conductivity, and the third period is made a relatively long period in which charged particles in the plasma are sufficiently accumulated on the dielectric layer as negative wall charges.

BEST MODE FOR CARRYING OUT THE INVENTION

Figure 5:
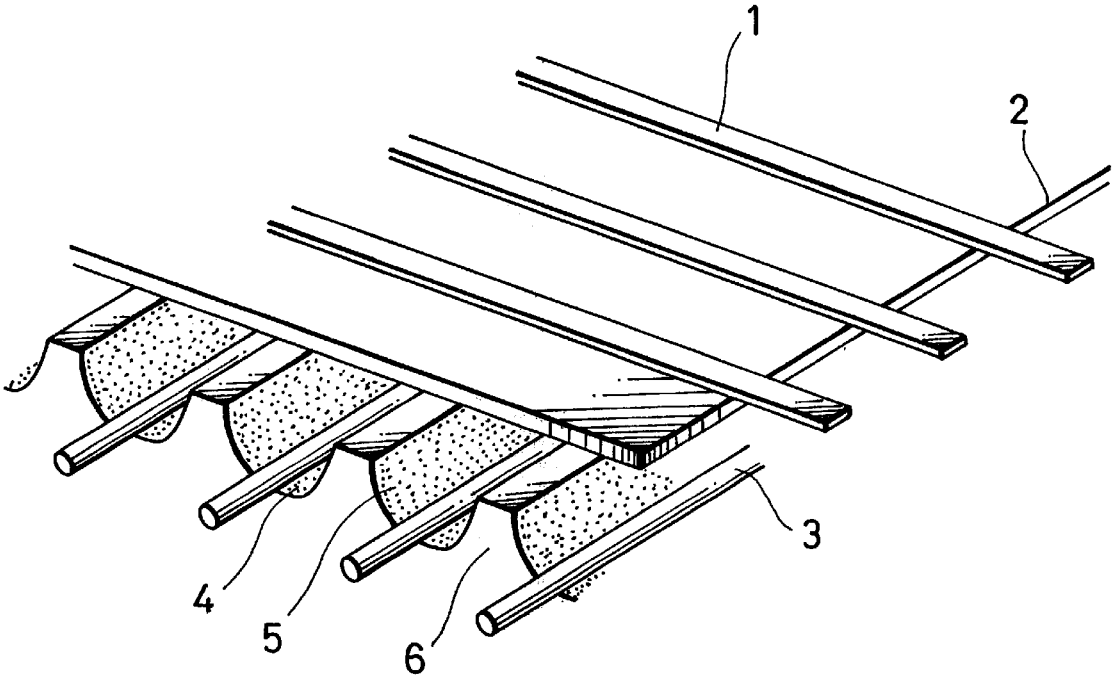
FIG. 5 is a developed perspective view showing an example of a semi-AC type discharge display device to which the driving methods according to the first and second prior arts and the first and second embodiments are applied.

Although at first the first embodiment of a driving method for a discharge display device according to the present invention will be described below with reference to FIGS. 2A to D, the discharge display device subjected to the driving method is the same as the semi-AC type discharge display device shown in FIG. 5 and described in the prior art example. As the discharge display device subjected to the driving method, an AC type discharge display device can also be used. An arrangement of the AC type discharge display device will be described later with reference to FIG. 6.

Reference symbol Tad denotes an address period, and reference symbol Tst denotes a sustain period.

It is assumed that, in a pixel selected in the address period Tad, negative wall charges have been accumulated on a dielectric layer 2 for covering a Y electrode 1. Since an operation in the address period Tad is performed by a driving method for an AC type discharge display device {plasma display panel (PDP)} which is generally performed, a description of the operation will be omitted.

Figures 1A, 1B, 1C, 1D:
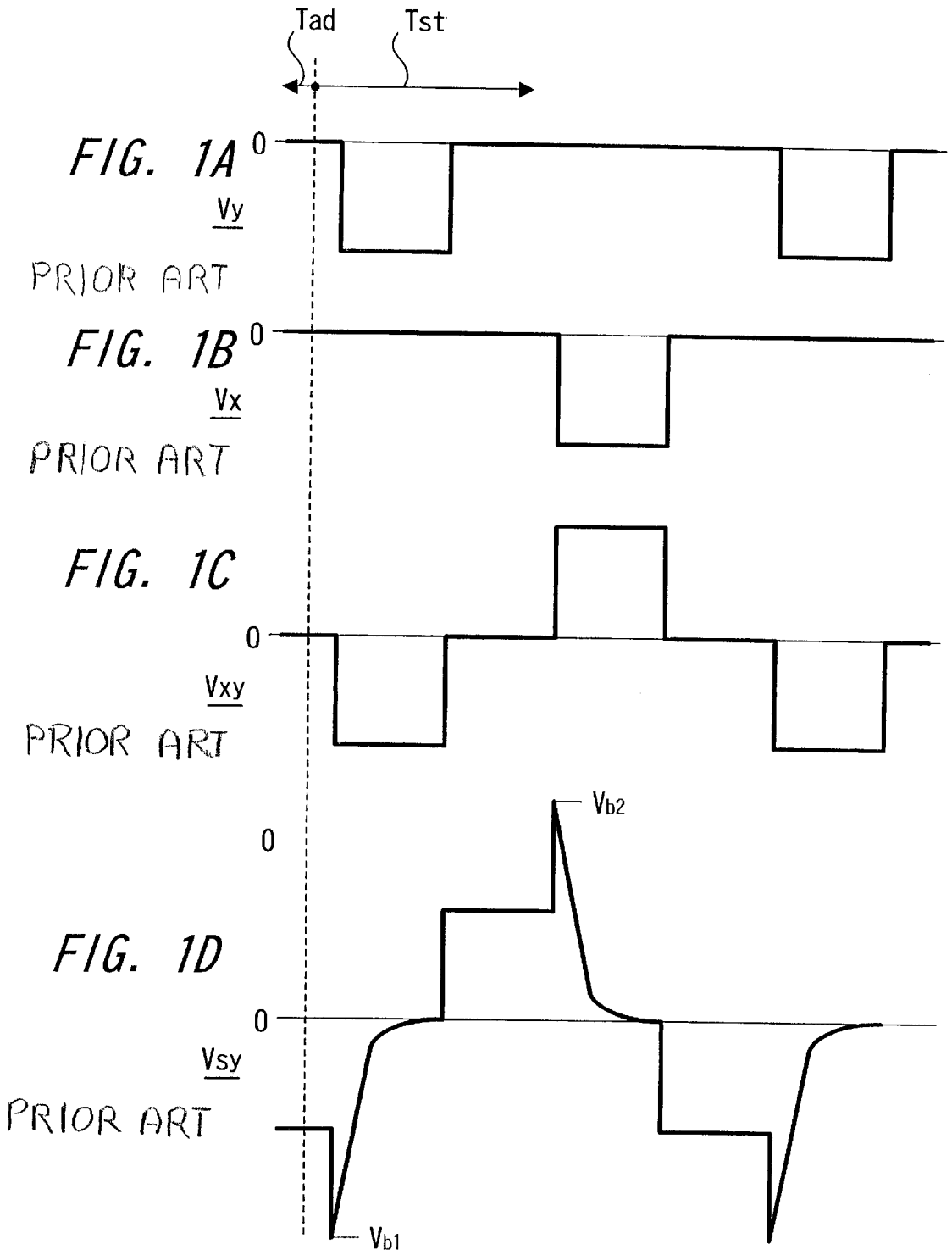
FIG. 1A PRIOR ART
FIG. 1B PRIOR ART
FIG. 1C PRIOR ART
FIG. 1D PRIOR ART
FIGS. 1A to D are timing charts showing a driving method for a discharge display device according to a prior art, in which reference symbol A denotes an applied voltage Vy to a Y electrode 1, reference symbol B denotes an applied voltage Vx to an X electrode 3, reference symbol C denotes a voltage between the Y electrode 1 and the X electrode 3, and reference symbol D denotes a surface potential of the Y electrode 1.
Figures 2A, 2B, 2C, 2D:
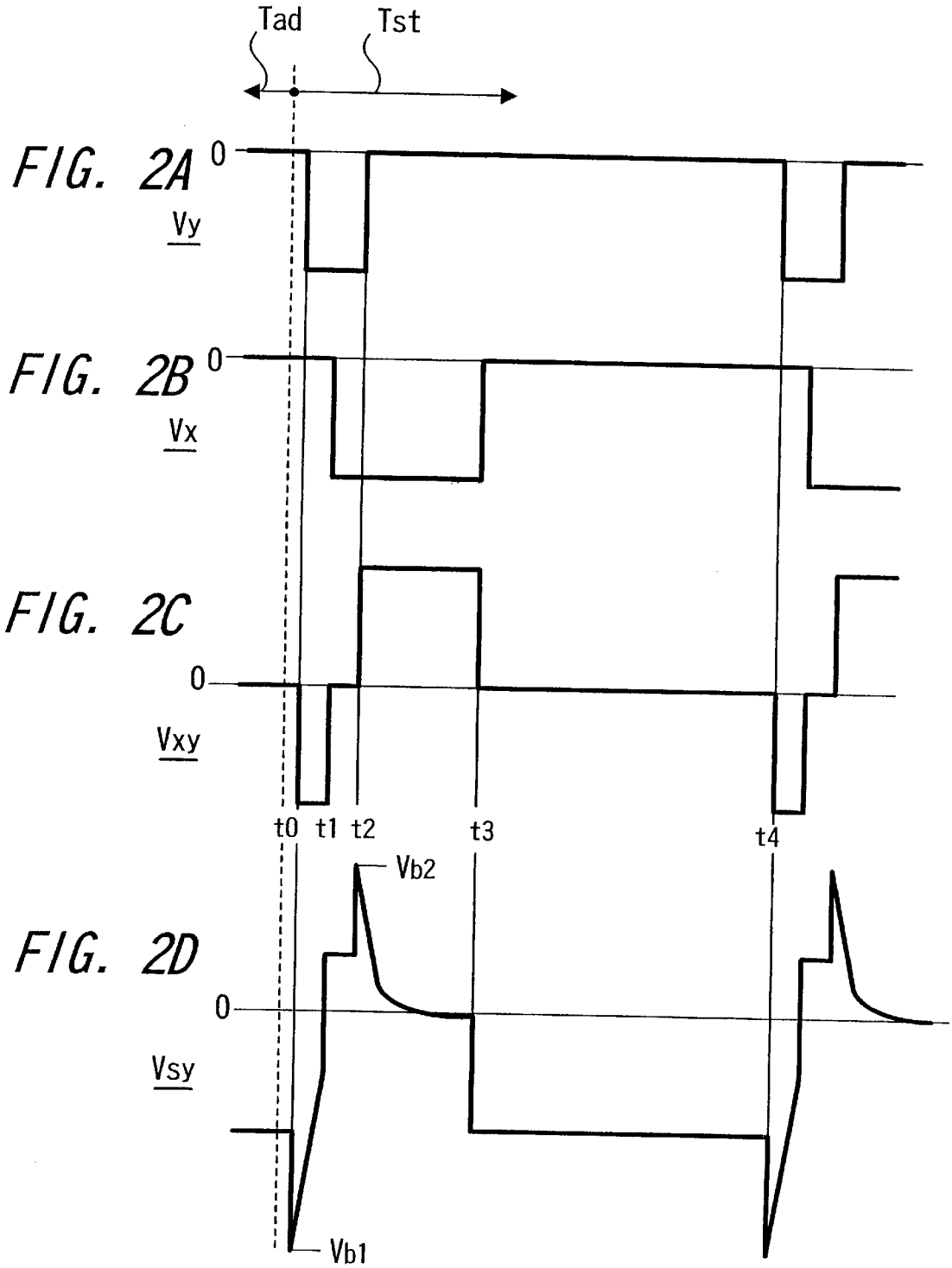
FIGS. 2A to D are timing charts showing a first embodiment of a driving method for an AC type discharge display device according to the present invention, in which reference symbol A denotes an applied voltage Vy to a Y electrode 1, reference symbol B denotes an applied voltage Vx to an X electrode 3, reference symbol C denotes a voltage between the Y electrode 1 and the X electrode 3, and reference symbol D denotes a surface potential of the Y electrode 1. Note that reference symbol Tad denotes an address period, and reference symbol Tst denotes a sustain period.

FIGS. 2A and B show voltages Vy and Vx applied to the Y electrode 1 and the X electrode 3, respectively, and FIG. 2C shows a voltage Vxy between the X electrode 3 and the Y electrode 1. The voltages Vy and Vx are negative pulse voltages having the equal cycle, but the pulse widths of the voltages are different from each other. The pulse width of the pulse voltage Vy is narrower than the pulse width of the pulse voltage Vx. The pulse voltages Vy and Vx has a phase relationship such that the central position of the pulse width of the pulse voltage Vy coincides with a trailing edge of the pulse voltage Vx.

The actual pulse widths of the pulse voltages Vy and Vx are different depending on the areas of the Y electrode 1 and the X electrode 3, the structure of a discharge cell, and the like. The pulse width of the pulse voltage Vy applied to the Y electrode 1 may be properly set to be a short time before drop of a decrease in a discharge start voltage caused by a plasma and metastable atoms generated by the first discharging generated by applying the pulse voltage Vy to the Y electrode 1 is reduced, i.e., within about 1.0 μsec. The pulse width of the pulse voltage Vx applied to the X electrode 3 is sufficiently longer than the pulse width of the pulse voltage Vy applied to the Y electrode 1, e.g., 3 μsec or longer (however, it is naturally shorter than the pulse cycle).

Changes at each of times t0 to t4 of the voltage (AC pulse voltage) Vxy between the X electrode 3 and the Y electrode 1 in FIG. 2C will be described below. The pulse voltage Vxy falls from 0 V to the negative side at a first time t0 of the sustain period Tst in accordance with the trailing edge of the pulse voltage Vy, rises at a time t1 in accordance with the trailing edge of the pulse voltage Vx to be 0 V (negative pulse between the times t0 and t1 is a sustain pulse, i.e., a discharge keeping pulse), rises from 0 V to the positive side at a time t2 in accordance with the trailing edge of the pulse voltage Vy, falls at a time t3 in accordance with the leading edge of the pulse voltage Vx, and falls from 0 V to the negative side at a time T4 in accordance with the trailing edge of the pulse voltage Vy. Next, generation of the sustain pulse is started. In this case, if the pulse width of the pulse voltage Vy applied to the Y electrode 1 is proper, the time t1 may be set immediately after the time t2.

In the address period Tad before the sustain period Tst, when it is assumed that negative wall charges are formed on the dielectric layer 2 covered on the Y electrode 1, the voltage by the negative wall charges is superposed on the applied pulse Vy to the Y electrode 1 at the time t0. For this reason, as shown in FIG. 2D, the voltage between the Y electrode 1 and the X electrode 3 becomes a sufficiently high voltage which exceeds a voltage Vb1 for starting discharging, and hence a first discharging occurs between the Y electrode 1 and the X electrode 3. At this time, the discharge space is filled with a plasma to be generated, i.e., positive and negative space charges and metastable atoms, and the negative wall charges which have been on the Y electrode 1 are eliminated by positive charges flown by an inter-electrode electric field, i.e., ions, and, on the contrary, accumulation of positive wall charges is started. This state keeps on for a short while even if the potentials of the Y electrode 1 and the X electrode 3 are equal to each other at the time t1. In the meantime, many space charges and many metastable atoms are generated in the discharge space, and an electrically conductive state is presented.

After a short time from the period in which the space charges remain, i.e., at the time t2, the potential of the Y electrode 1 is returned to 0 V, and the discharging is temporarily stopped. The state of the discharge space at this time is different from the state at the time t0, and the discharge space is still sufficiently filled with space charges and metastable atoms. For this reason, a state wherein re-discharging easily may occur is presented. An effect that such a state decreases a re-discharge start voltage is called a priming effect. Due to the priming effect, at the time t2, a second discharging occurs at a discharge start voltage Vb2 whose absolute value is considerably lower than that of the discharge start voltage Vb1 at the time T0, and the Y electrode 1 is set on the positive potential side again. For this reason, negative wall charges are accumulated on the Y electrode 1 side from the space charges generated by the second discharging. Since the period between the times t2 to t3 is longer than the period from the time t0 to the time t1, the negative wall charges are sufficiently accumulated until the time t3, and, at the time t4, the state returns to the state at the time to. In this manner, the sustain discharging can keep on.

As preferable times of the periods between the times t0 and t4, the period between the times t0 and t1 is 1 μsec, the period between the times t1 and t2 is 1 μsec too, the period between the times t2 and t3 is 3 to 4 μsec, and the period between the times t3 and t4 is 4 to 5 μsec. The times of the periods are selected depending on the sizes and shapes of the Y electrode 1 and the X electrode 3 and the type of the discharge gas.

It is an important thing in the driving method for the discharge display device that the second discharging is generated within a period in which the plasma and the metastable atoms generated by the first discharging exist. It was confirmed by an experiment that, when the second discharging was generated at such a timing, the second discharge start voltage Vb2 had an absolute value which was considerably lower than that of the first discharge start voltage by, e.g., about 30 V to 50 V or higher, by means of the priming effect obtained by the first discharging. This means that the ion impact on the electrode can be considerably reduced. In general, the gas discharge is started by applying a high voltage across discharge electrodes at the start of discharging which applies a strong ion impact on a discharge electrode serving a cathode, and radiates secondary electrons into a space. Therefore, when the priming caused by space charges, metastable atoms, or the like is effected in a discharge space in advance, discharging is started without applying such a high voltage. Once discharging is started, a voltage for causing the discharging to keep on, i.e., the sustain voltage is considerably lower than the discharge start voltage. For this reason, the ion impact is slightly made on the electrode.

However, in the first embodiment of the driving method for the AC type discharge display device, although the wall charges are eliminated by the plasma remaining in the discharge space, the pulse width of a narrow-width pulse voltage used in this case is not easily set. For example, more specifically, when the pulse width of the narrow-width pulse voltage is excessively small, because of the influence of a leading delay time of discharging, luminance may decrease, or a discharge voltage may rise. When the pulse width of the narrow-width pulse voltage is excessively large, the same wall charges as those formed by sustain discharging of a normal AC type discharge display device are formed, the wall charges are superposed on a reverse voltage to be applied next, and re-discharging is caused by a high voltage in a state wherein a plasma decreases. For this reason, the ion impact on the electrode is inevitably made.

In the second embodiment of a driving method for an AC type discharge display device to be described later, in a driving method for an AC type discharge display device having a two-electrode structure which is simple and easily manufactured, the charge of wall charges can be controlled at a low voltage, and also a positive column which does not cause cathode drop is formed, so that light emission efficiency is improved.

The second embodiment of a driving method for a discharge display device according to the present invention will be described below with reference to FIGS. 3A to D. The discharge display device subjected to the driving method is the semi-AC type discharge display device shown in FIG. 5 and described in the prior art example. As the discharge display device subjected to the driving method, an AC type discharge display device can also be used. An arrangement of the AC type discharge display device will be described later with reference to FIG. 6. Reference symbol Tad denotes an address period, and reference symbol Tst denotes a sustain period.

Figures 3A, 3B, 3C, 3D:
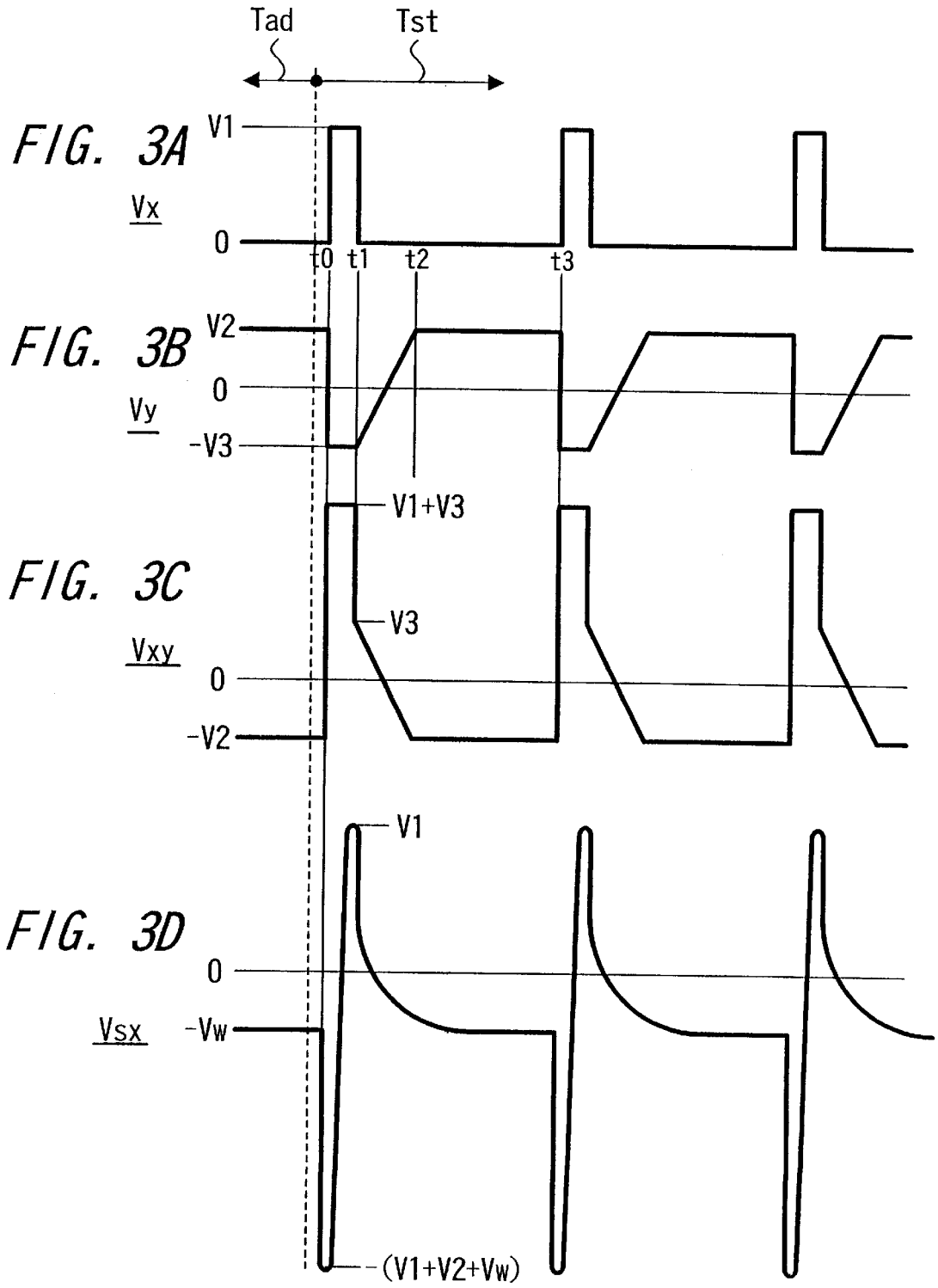
FIGS. 3A to D are timing charts showing a second embodiment of a driving method for an AC type discharge display device according to the present invention, in which reference symbol A denotes an applied voltage Vx to an X electrode 3, reference symbol B denotes an applied voltage vy to a Y electrode 1, reference symbol C denotes a voltage between the Y electrode 1 and the X electrode 3, and reference symbol D denotes a surface potential of the Y electrode 1.
Figure 4:
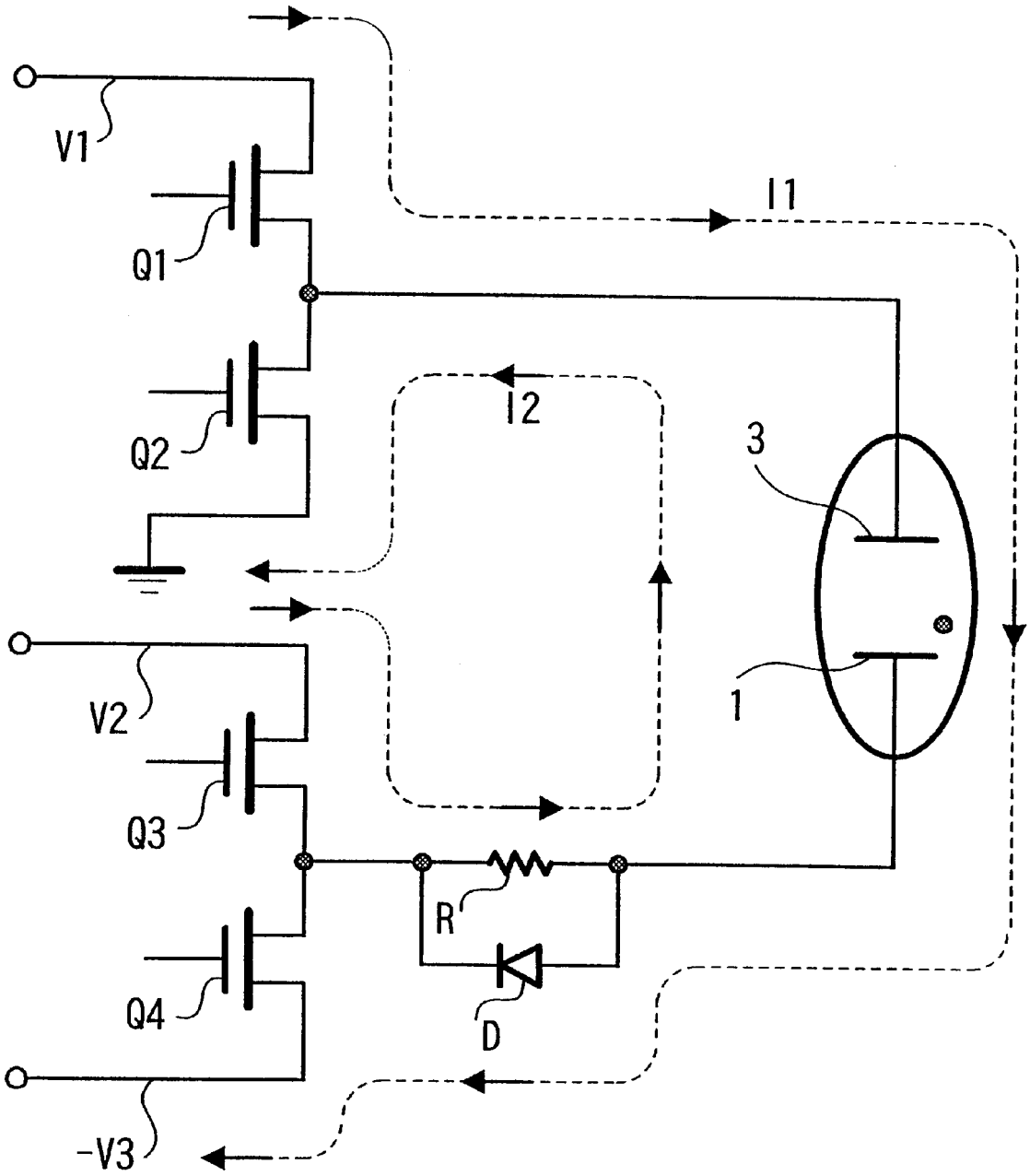
FIG. 4 is a circuit diagram showing an example of a drive circuit applied to the second embodiment.

FIG. 4 shows a drive circuit applied to the driving method in FIG. 3. A drive circuit for an X electrode 3 is constituted such that a series circuit of MOS-FETs Q1 and Q2 is connected between a power source having a voltage of V1 and a ground, and the connection middle point between the MOS-FETs is connected to the X electrode 3. A drive circuit for a Y electrode 1 is constituted such that a series circuit of MOS-FETs Q3 and Q4 is connected between power sources having voltages V2 and −V3, respectively, and the connection mid-point between the MOS-FETs is connected to the Y electrode 1 through a current control circuit constituted by a parallel circuit of a resistor R and a diode D.

FIG. 3A shows a voltage Vx applied to the X electrode 3. This voltage Vx is a narrow-width positive pulse voltage Vx. The pulse period between times to and t1 in which the FETs Q1 and Q2 are on and off, respectively is about 0.5 to 1.0 μsec, and the amplitude voltage V1 thereof is, e.g., about +150 V. When the FETs Q1 and Q2 are off and on, respectively, the pulse voltage Vx is set to be 0 V.

FIG. 3B shows a voltage Vy applied to the Y electrode 1. The voltage Vy is a trapezoidal-waveform voltage which is changed positive or negative. At a time to, the FETs Q3 and Q4 which are in on and off states are turned off and on, respectively, and the voltage instantaneously falls from the voltage V2 (e.g., +70 V) to the voltage −3V (e.g., −100 V) such that the existence of the resistor R (to be described later) is rejected by the existence of the diode D. Since the FETs Q3 and Q4 are kept in OFF and ON states, respectively, in the period from the time t0 to a time t1, the voltage is kept at −V3. Since the FETs Q3 and Q4 are turned off and on, respectively, at the time t1, the voltage obliquely rises from the voltage −V3 to V2 due to the existence of the resistor R from the time t1 to a time t2 (e.g., a period of about 1.0 μsec). Since the MOS-FETs Q3 and Q4 are kept in OFF and ON states, respectively, from the time t2 to a time t3, the voltage is kept at V2. Since the MOS-FETs Q3 and Q4 are turned on and off, respectively, at the time t3, the voltage falls from the voltage V2 to the voltage −V3 due to the existence of the diode D.

In the drive circuit in FIG. 4, the same current regulating circuit as that of the drive circuit on the Y electrode 1 side is arranged in the drive circuit on the X electrode 3 side, and the falling of the pulse at the time t0 of the pulse voltage Vx can also be made gentle.

When the voltages Vx and Vy applied to the X electrode 3 and the Y electrode 1 have the waveforms shown in FIGS. 3A and B, respectively, even if the X electrode 3 is on the negative electrode side to be the side on which the ion impact is made to cause a discharge current to flow, since the voltage in the discharge space is suppressed to a low level, the X electrode 3 does not receive the ion impact.

The reason why the X electrode 3 does not receive the ion impact will be described below with reference to the waveform of the voltage Vxy between the X electrode 3 and the Y electrode 1 shown in FIG. 3C and the waveform of a surface potential Vsx of the X electrode 3 shown in FIG. 3D in consideration of wall charges.

Although details are omitted in the description of the embodiment of the present invention, it is assumed that negative wall charges are selectively formed for respective pixels on the dielectric layer 2 of the Y electrode 1 in the address period Tad of an image display. In general, when a sustain pulse is applied to pixels on which negative wall charges are formed, continuous display discharging is performed.

The pulse voltages Vx and Vy shown in FIGS. 3A and B and generated from the drive circuit shown in FIG. 4 are applied to the X electrode 3 and the Y electrode 1 of the pixels on which negative wall charges are formed. At this time, as shown in FIG. 4, currents I1 and I2 flow in the discharge space between the X electrode 3 and the Y electrode 1. In this case, for example, the voltages V1, V2, and −V3 are given by V1=150 (V) V, V2=70 (V) V, and −V3=−100 (V), respectively. A voltage Vw of the wall charges is given by Vw=70 (V).

In a period 1 between the times t0 and t1, the Y electrode 1 operates as a cathode side, V1+V3+Vw=320 (V) is applied across the X electrode 3 and the Y electrode 1, and a first discharging is started. At this time, the discharge current I1, as shown in FIG. 4, flows into the power source having a voltage of −V3 through between the X electrode 3 and the Y electrode 1 of the discharge display device and the diode D. For this reason, the negative wall charges are eliminated, and, immediately, accumulation of positive wall charges is started. Since the period 1 between the times t0 and t1 is a short time of about 0.5 to 1.0 μsec as described above, even if the wall charges are formed on the Y electrode 1 at the time t1 to stop the discharging, a sufficient plasma still exists in the discharge space, and the discharge space keeps conductivity. Under this state, at the time t1, the polarity of the drive circuit is switched.

In this manner, since the discharge space has the conductivity, as shown in FIG. 4, the discharge current I2 w having a direction in which wall charges are eliminated flows from the power source having a voltage of V2 to the ground through the resistor R and between the Y electrode 1 and the X electrode 3 of the discharge display device. At this time, due to the existence of the resistor R, the voltage Vxy between the X electrode 3 and the Y electrode 1 gradually rises as shown in FIG. 3C. More specifically, if the wall voltage Vw obtained by the wall charges generated in the period 1 between the times t0and t1 is a maximum of V1+V3=250 (V), at the time t1 at which the voltage Vx of the X electrode 3 changes from V1=150 (V) into 0 V, the voltage applied to the Y electrode 1 is still −V3=100 (V) because the current is regulated. For this reason, the voltage Vxy between both the electrodes is V3=100 (V) as shown in FIG. 3C.

Therefore, as shown in FIG. 3D, with reference to the X electrode 3, the surface potential of the Y electrode 1, i.e., the voltage actually applied to the discharge space is such that the voltage Vxy=V3=100 (V) between the X electrode 3 and the Y electrode 1 shown in FIG. 3C is superposed on the voltage Vw=250 (V) of the wall charges formed in the period 1 between the times t0 and t1 of first sustain discharging. In this case, since the voltage Vy of the Y electrode is still a negative potential at the time t1, the voltage of the discharge space is V1+V3−V3=100 (V).

At such a relatively low voltage of 100 V, in general, a new discharging cannot be excited in the discharge space. However, in this case, the plasma still remains in the discharge space, and the discharge space has a conductivity. Therefore, the discharge current I2 shown in FIG. 4 flows in the direction shown in FIG. 4 at the time t1. At this time, a part of the positive wall charges formed by the first discharging in the period 1 between the times t0 and t1 is immediately lost until the wall voltage obtained by the positive wall charges decreases to about V3=100 (V).

Thereafter, although the potential of the Y electrode 1 gradually rises in a period 2 between the times t1 and t2, since the rising rate thereof becomes moderate, the wall charges are gradually lost as the potential of the Y electrode 1 rises. Therefore, even if the voltage Vxy between the X electrode 3 and the Y electrode 1 is superposed on the remaining wall voltage Vw, a high discharge space voltage is not generated. In the period 2 between the times t1 and t2, even if the discharge space voltage is low, a current flows, and the ion impact caused by accelerated charged particles, i.e., a action and β action, occur, and a current is bred. For this reason, the plasma is not disappeared.

However, γ action that the cathode is strongly impacted because a low voltage to cause the cathode to emit secondary electrons does not occur. Therefore, the Y electrode 1 which becomes the cathode side after the time t1 does not receive any ion impact.

When the period 2 is ended, at the time t2, the voltage Vy of the Y electrode 1 is V2 {=70 (V)}, and the voltage Vx of the X electrode 3 is 0V. For this reason, the resultant polarities are reverse to the polarities in the period 1 between the times t0 and t1, and negative wall charges are formed on a Y electrode 11. A period 3 from the time t2 to the time t3 of the next pulse application is set to be a time (about 2 μsec or longer) being enough to eliminate the plasma from the discharge space and recover insulating property again. In this case, negative wall charges are fixed, a wall voltage, e.g., −Vw=−70 (V) which can excite new discharging at the next time t3 is generated to contribute to the next discharge.

An example of the AC type discharge display device subjected to the driving method for a discharge display device described with reference to FIGS. 2 and 3 will be described below with reference to the sectional view in FIG. 6. A plurality of second line-shaped (stripe-shaped) address electrodes (discharge electrodes) 12 each having a predetermined width are coated to be formed at a predetermined interval on a front glass plate 11, and the plurality of second address electrodes 12 are covered with a dielectric layer 14 to form AC type electrodes. A protective layer 15 is formed to be coated on the dielectric layer 14.

A plurality of stripe-shaped partition walls 16 each having a predetermined width are arranged at a predetermined interval along a direction crossing the plurality of second address electrodes 12 on a near-surface glass plate 19. On the near-surface glass plate 19, a plurality of first wire-like address electrodes (discharge electrodes) 18 each having a predetermined diameter (e.g., 50 to 100 μm) and consisting of a metal are independently arranged parallel to the respective partition walls 16 at a predetermined interval between adjacent ones of the plurality of partition walls 16. The plurality of first address electrodes 18 are independently covered with dielectric layers 20 to form AC type electrodes. On both the wall surfaces of each of the partition walls 16 and on the rear-surface glass plate 19 between both the wall surfaces and each of the first address electrodes 18 covered with the dielectric layers 20, phosphor layers 17 which emits red, green, and blue lights are sequentially and cyclically coated for the respective first address electrodes 18.

The plurality of second address electrodes 12 are formed such that a transparent conductive thin film, which is constituted by a thin film such as a metal thin film consisting of copper-chromium and so on or an indium tin oxide thin film and is formed to be coated on the Y electrode 11 is etched.

The dielectric layer 14 is formed such that a low-melting-point glass is screen-printed and the low-melting-point glass is then sintered. The protective layer 15 is formed by vacuum-depositing a magnesium oxide or the like. Although the partition walls 16 are formed by laminate-printing a low-melting glass paste by a screen printing method to have a desired height, the partition walls can also be formed by a sandblasting method, a photomechanical process or the like.

Although the first address electrode 18 has a wire shape, the first address electrodes may be formed such that a metal plate is etched to have a stripe shape. Also, the second address electrode 12 may be formed to have a wire shape.

Figure 6:
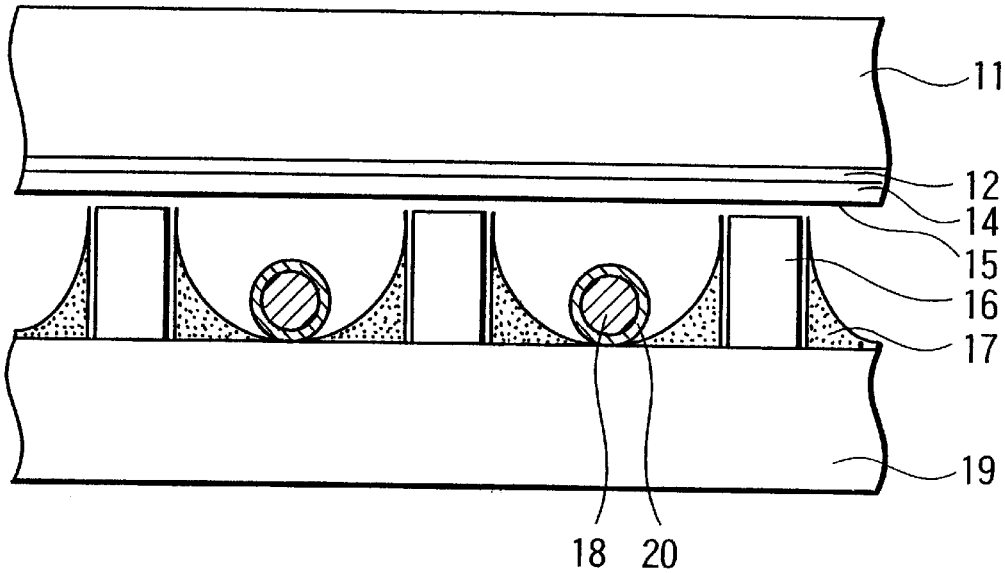
FIG. 6 is a sectional view showing an example of an AC type discharge display device to which the driving methods according to the first and second embodiments are applied.

In the AC type discharge display device in FIG. 6, since the positions of the first address electrodes 18 are on the upper surface of the phosphor layers 17, an electric field formed by the first address electrodes 18 and the second address electrodes 12 before discharging do not traverse the phosphor layers 17. For this reason, even if a cathode effect is generated after the discharging is started, the electric field does not essentially change. Therefore, the phosphor layers 17 themselves do not receive the ion impact.

According to the first invention described above, in a driving method for an AC type discharge display device having one pair of discharge electrodes which are opposite to each other to cross through a discharge gas and each of which is constituted by a plurality of line-shaped electrodes, the plurality of line-shaped electrodes of at least one discharge electrode of the pair of discharge electrodes being covered with a dielectric layer, an AC discharge keeping pulse applied across one pair of discharge electrodes is constituted by a first pulse and a second pulse having a polarity reverse to the polarity of the first pulse and generated next to the first pulse, the first pulse is made a narrow-width pulse having a pulse width set within a time in which a priming effect of charged particles or metastable atoms generated by the first pulse is kept in the discharge space, a second pulse is made a wide-width pulse which is generated before the priming effect obtained by the first pulse is disappeared and within a time being close to the first pulse and has a pulse width for giving a sufficient time until the discharging is stopped by forming wall charges on the dielectric layer, and the AC discharge keeping pulse constituted by the first and second pulses is continuously applied across the pair of discharge electrodes to perform the sustain discharging. For this reason, a driving method for an AC type discharge display device which can expect the effect described below can be obtained.

According to the first present invention, in a driving method for an AC type discharge display device having a simple structure and a two-electrode structure which can be easily manufactured, a driving method for an AC type (semi-AC type may also be used) discharge display device which can decrease influence of the ion impact on a discharge electrode or a phosphor can be obtained.

In addition, according to the first present invention, when the second discharging is generated immediately after the first discharging, the negative charges can be formed on the discharge electrode serving as an AC type electrode. For this reason, a driving method for an AC type discharge display device which can cause the AC type discharge display device to have the same memory function as that of a conventional AC type discharge display device.

According to the second present invention, in a driving method for an AC type discharge display device having first and second discharge electrodes which are opposite to each other to cross through a discharge gas and each of which is constituted by a plurality of line-shaped electrodes, the plurality of line-shaped electrodes of at least one discharge electrode of the first and second discharge electrodes being covered with a dielectric layer, a discharge display period in which a sustain pulse applied across one pair of discharge electrodes is constituted by a first period serving as a beginning period, a second period serving as an intermediate period, and a third period serving as a last period, the first period is a relatively short period in which an external voltage is superposed on a wall voltage generated by the negative address wall charges formed on the dielectric layer in an address period in advance to generate a high discharge space voltage, a first sustain display discharging for causing the ion impact to be made on a discharge electrode where the negative wall charges are formed on the dielectric layer to generate the negative glow is excited, a plasma constituted by positive and negative charged particles and metastable atoms generated by the first sustain display discharging sufficiently remains while the negative address wall charges on the dielectric layer are eliminated to form positive wall charges, the second period is a relatively short period in which the positive wall charges newly formed on the dielectric layer in the first period switch an external drive voltage and its polarity such that a discharge current having a direction being opposite to the direction of a discharge current flowing in the first period flows by the conductivity of the remaining plasma, the switched external drive voltage is made gradually high such that the strong ion impact is prevented from being made on the discharge electrode in which a space voltage is excessively high by superposing the positive wall charges newly formed on the dielectric layer on the switched external drive voltage, and the positive wall charges are gradually eliminated such that the plasma remains in the discharge space or is newly formed to cause the discharge space to keep a conductivity, and the third period is a relatively long period in which charged particles in the plasma are sufficiently accumulated on the dielectric layer as negative wall charges. For this reason, a driving method for an AC type discharge display device which can expect the effect described below can be obtained.

According to the second present invention, in a driving method for an AC type discharge display device having a simple structure and a two-electrode structure which can be easily manufactured, a driving method for an AC type (semi-AC type may also be used) discharge display device which can decrease influence of the ion impact on the discharge electrode or the phosphor can be obtained.

In addition, according to the second present invention, when the second discharging is generated immediately after the first discharging, the negative charges can be formed on a discharge electrode serving as an AC type electrode. For this reason, a driving method for an AC type discharge display device which can cause the AC type discharge display device to have the same memory function as that of a normal AC type discharge display device.

Furthermore, according to the second present invention, in a driving method for an AC type discharge display device having a simple structure and a two-electrode structure which can be easily manufactured, the charges of the wall charges can be controlled at a low voltage, and also a positive column which does not cause cathode drop is formed, so that a driving method for an AC type discharge display device having high emission efficiency can be obtained.

What is claimed is:

1. In a driving method for an AC type discharge display device having one pair of discharge electrodes opposite to each other through a discharge gas filled space and each of said discharge electrodes having a plurality of line-shaped electrodes, at least one discharge electrode of the pair of discharge electrodes being covered with a dielectric layer, said driving method comprising the steps of: a) applying an AC discharge sustaining pulse across the pair of discharge electrodes said AC discharge sustainig pulse having first and second pulses, a predetermined first period between said first and second pulses and a predetermined second period between the end of said second pulse and the beginning of said first pulse of the next AC discharge sustaining pulse, said first pulse being a narrow-width pulse having a pulse width set within a time in which a priming effect of charged particles and metastable atoms generated by said first pulse is kept in the discharge space and said second pulse being a wide width pulse having a width wider than the width of the first pulse and sufficient for giving time until a discharging is stopped by forming wall charges on the dielectric layer and having a polarity reverse to the polarity of said first pulse and generated next to said first pulse; and b) applying said AC discharge sustaining pulse continuously across the pair of discharge electrodes to perform a sustained discharging.

2. The driving method according to claim 1 wherein said second pulse of said AC discharge sustaining pulse is generated before said priming effect obtained by said first pulse disappears.

3. The driving method for an AC type discharge display device according to claim 2, said AC type discharge display device further comprising an external drive circuit for supplying voltage for said first and second pulses, said step of applying said AC discharge sustaining pulse characterized in that: a) said first period is 1 $\mu$sec; b) said first pulse is formed by an external voltage produced by said external drive circuit superposed on a wall voltage generated by negative address wall charges formed beforehand on the dielectric layer of one of the electrodes in an address period to generate a high discharge space voltage; c) said application of said AC discharging sustaining pulse causing the exciting of a first sustain display discharging for causing an ion impact to be made on the discharge electrode where negative wall charges are formed on the dielectric layer to generate a negative glow, a plasma constituted by said charged particles having positive and negative charges and said metastable atoms generated by said first sustain display discharging so as to remain in the discharge space and allow a first discharge current to flow while negative address wall charges on the dielectric layer are eliminated to form positive wall charges, the newly formed positive wall charges switching a polarity of the voltage generated by said external drive circuit such that a second discharge current having a direction opposite to the direction of the first discharge current flows by the conductivity of the remaining plasma; d) raising said switched voltage gradually such that a strong ion impact is prevented form being made on one of the discharge electrodes due to an excessively high voltage in the discharge space formed by superposing the newly formed wall positive charges on the switched external drive voltage, and the positive wall charges are gradually eliminated such that remaining and newly formed plasma in the discharge space causes the discharge space to keep a conductivity; and e) said second period being long relative to said width of said first and second pulses, in which charged particles in the plasma are sufficiently accumulated on the dielectric layer as negative wall charges.

* * * * *